United States Patent [19]

Hart

[11] 4,340,256

[45] Jul. 20, 1982

[54] DIAMOND PLANAR CUTTER

[76] Inventor: Jacque M. Hart, 3444 Garrison, San Diego, Calif. 92106

[21] Appl. No.: 47,253

[22] Filed: Jun. 11, 1979

Related U.S. Application Data

[63] Continuation-in-part of Ser. No. 820,081, Jul. 29, 1977, abandoned.

[51] Int. Cl.[3] ..... E01C 23/09

[52] U.S. Cl. ..... 299/87; 299/39; 51/176; 125/4; 172/119

[58] Field of Search ..... 299/39, 87, 89, 56, 299/57, 81; 51/174, 176, 206 R, 206.5; 125/4; 172/119, 719; 175/329, 330

[56] References Cited

U.S. PATENT DOCUMENTS

| | | | |
|---|---|---|---|
| 2,823,023 | 2/1958 | Hlinsky | 299/57 |
| 3,069,816 | 12/1962 | Pratt et al. | 51/206 R |
| 3,343,308 | 9/1967 | Fessel | 51/206 R X |
| 3,560,050 | 2/1971 | Lockwood | 299/89 X |
| 3,827,755 | 8/1974 | Allen | 299/81 |
| 3,860,291 | 1/1975 | Rauch et al. | 299/87 X |
| 4,022,286 | 5/1977 | Gill | 299/81 X |

FOREIGN PATENT DOCUMENTS

| | | | |
|---|---|---|---|
| 4754444 | 9/1975 | U.S.S.R. | 172/119 |

*Primary Examiner*—Ernest R. Purser

*Attorney, Agent, or Firm*—Ellsworth R. Roston; Charles H. Schwartz

[57] ABSTRACT

A shaft carries helically wound support surfaces for retaining cutter segments, such as diamond cutters, in a helical path. Oppositely wound helices extend continuously from the center to a limit position on each side of the cutter head. Each of the support surfaces is disposed in a direction substantially perpendicular to an extended surface to be cut or planed so as to provide a cut in the extended surface with a minimal force and without any side skipping of the cutter segments. Double wound helices provide a backup segment in the same plane and a natural balancing effect. Each of the helices in each double wound helix is uniformly spaced from the other double wound helix and is terminated at the same position at the center and at the limit position as the other helix but may be angularly displaced from the other helix by an angle of 90° at the center and 180° at the limit position. The cutter segments may be disposed on the helices in a balanced relationship. For example, pairs of cutter segments may be disposed on the helices in a double winding having a particular relationship, such as a diametrically opposed relationship, in a plane substantially perpendicular to the axis of the helices. Furthermore, the cutter segments may be disposed in staggered relationship on progressive turns of the helices to define a helix transverse to the helices in the double winding but having the same axis as the helices of the double winding.

24 Claims, 9 Drawing Figures

DIAMOND PLANAR CUTTER

This is a continuation-in-part of application Ser. No. 820,081 filed July 29, 1977, entitled "Diamond Planar Cutter".

In many applications, it is desirable and necessary to have a substantially planar concrete surface without any mounts or depressions, and/or to strip or otherwise remove worn or deteriorated specialty coatings leaving a clean planar surface for reapplication of said specialty coatings. Various devices have been proposed for cutting planar surfaces into existing concrete, and for stripping existing coating from planar surfaces. One such device is described in U.S. Pat. No. 3,398,989. In this device, individual diamonds are set in a helical pattern which is wound onto a surface having a series of parallel grooves. The resulting cutter, due to the use of individually set diamonds, would be extremely expensive to produce. In addition, such a device is not capable of cutting a smooth planar surface but rather cuts a planar surface that is grooved.

U.S. Pat. No. 3,306,669 describes a similar device without helical diamond placement.

Diamond cutter blades using standard diamond cutter segments are commonly employed for grooving and otherwise working the surface of concrete similar materials. The use of such cutters to grind concrete or cut rain grooves on highways is well-known. Typically, such cutters have a plurality of diamond cutter segments permanently secured to the blade in end-to-end relationship. These blades are mounted on a common shaft in a side-to-side relationship with or without spacers to form a cylindrical surface. A typical 12" diameter blade may incorporate eighteen cutter segments per blade at a cost in excess of $25.00 per segment. The width of each segment is typically 0.187 inches. Therefore, a large number of blades and segments would be required to produce a planing cutter. For example, a continuous cylindrical surface 2 feet in length would cost on the order of $54,000.00.

It is therefore desirable to have a diamond cutter apparatus which is capable of planing concrete to a smooth ungrooved, regular surface, utilizing a relatively small number of standard diamond cutter segments.

In an exemplary embodiment of the invention, the limitations of prior art devices are overcome by the use of co-wound helical support structure with replaceable diamond cutter elements (segments) positioned along plural helical surfaces. The use of helical surfaces permits the segments to be positioned so that the segments are longitudinally overlapping without utilizing an unnecessarily large number of segments. The reduction in the number of required segments reduces the initial cost of such device, whereas the replaceability of the segments, and/or their retainer structures on the support structure, produces a long useful life.

A central shaft supports the helical surfaces. A first half of the shaft is covered by helical surfaces wound in a first direction, whereas the other half of the shaft is covered by helical surfaces wound in the opposite direction. Each of the helical surfaces extends in an uninterrupted fashion from a limit position to a central position where it is preferably displaced from the other helical surfaces by a perpendicular angular distance. Each of the support surfaces is disposed in a direction substantially perpendicular to an extended surface to be cut or planed. Thus, the tendency for a rotating helical surface in contact with a planar surface such as concrete to "walk" due to the screw action is counter-balanced by equal and opposite forces operated in the oppositely wound surfaces.

Though single wound helices may be used, double would helices are preferably utilized on each half of the shaft so that helical terminations (and therefore minimum cutter segments spacings) at the longitudinal center of the cutter are reduced. As used hereinafter, the term "double wound" should be understood to include two or more co-wound helices in which the helix in each double wound helix is interleaved with, and preferably uniformly spaced from, the other helix in each double wound helix. Furthermore, each helix in each double wound helix preferably is provided with the same limit and control positions at opposite ends as the other helix but is angularly displaced from the other helix by an angle of approximately 180°. In addition, each double wound helix is preferably displaced at the center by an angle of approximately 90° from the other double wound helix.

Means are provided for cooling the cutting segments engaging the extended surface. Such means include openings, preferably slots, in the support surfaces at positions between the cutter segments. A cooling fluid such as water is introduced to the openings to provide for the flow of fluid to the cutter segments which engage the extended surface. Alternatively, fluid may be introduced to the cutter segments from a position above the segments to flow to the cutting surface.

The cutter segments may be disposed on the helices in a balanced relationship. For example, pairs of cutter segments may be disposed on the helices in a double winding so that they lie in a particular relationship, such as a diametrically opposed relationship, in a plane substantially perpendicular to the axis of the helices. Furthermore, the cutter segments may be disposed in staggered relationship on progressive turns of the helices so that they define a helix which is transverse to the helices in the double windings but which has the same axis as the helices of the double winding.

It will be understood that the invention is not limited for use with diamond cutter segments but that the invention does have a special utility with such cutters. Helical surfaces are an especially advantageous way of positioning the cutter segments in a helical path.

It is, therefore, an object of the invention to provide a new and improved diamond planar cutter. The cutter sharply reduces the number of cutter segments necessary to produce a smooth planing operation. Strong side forces are eliminated, or at least minimized, by the use of the oppositely wound helices on opposite sides of a central position. Strong side forces are eliminated, or at least minimized, by the disposition of the helices in perpendicular relationship to the extended surface to be planed. Strong side forces are also eliminated or at least minimized by the use of double wound helices, preferably uniformly interleaved, and by the termination of the windings in each double winding in a particular angular relationship. The oppositely wound helices also cause a sweeping action for the cutting debris and deliver the debris to the outer ends of the cutter.

Other objects and many attendant advantages of the invention will become more apparent upon a reading of the following detailed description together with the drawings in which like reference numbers refer to like parts throughout and in which FIG. 1 is a side elevation view of the cutter assembly mounted on a vehicle;

Figure 1:
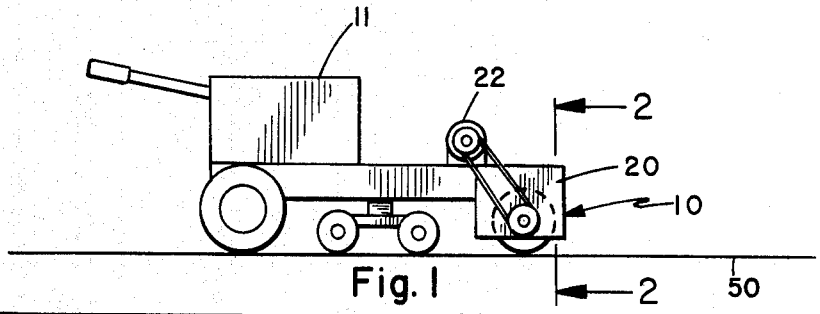

FIG. 8 is an enlarged front elevational view of another embodiment of the invention and shows apparatus for introducing water to the embodiment to cool the embodiment and further shows the positioning of cutter elements to balance the assembly; and FIG. 9 is an enlarged front elevational view of another embodiment to provide further balance to the embodiment and to minimize and equalize the forces on the apparatus at successive instants of time.

Referring now to the drawings, there is illustrated a cutter assembly 10 mounted on the front end of a self-propelled chassis 11.

Figure 2:
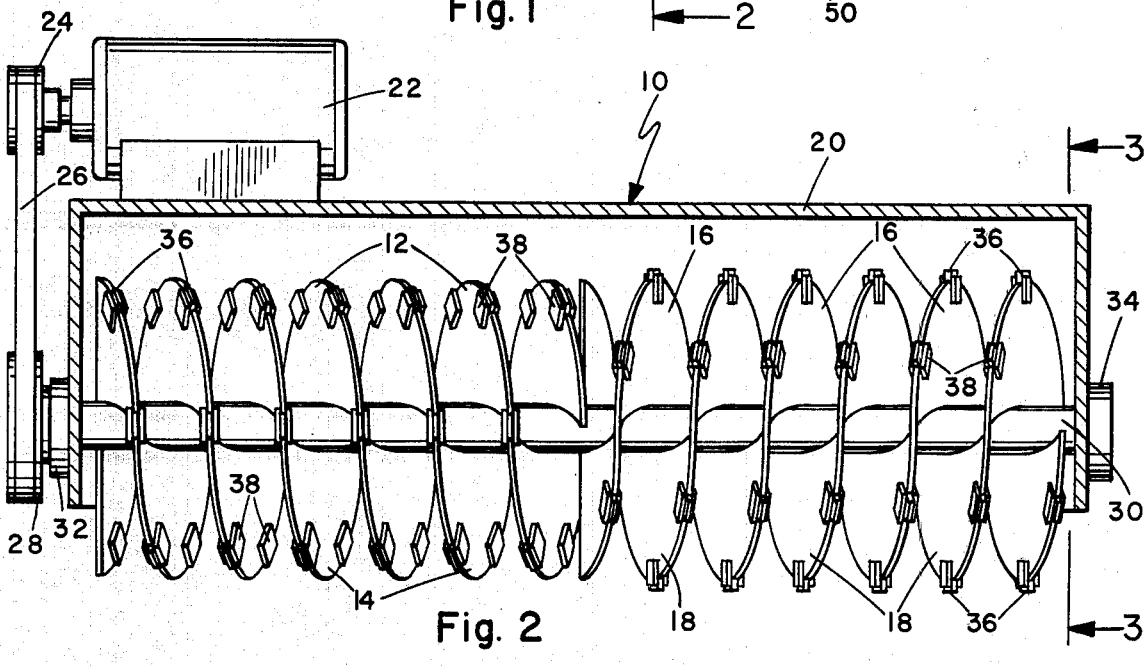
FIG. 2 is an enlarged sectional view taken on lines 2—2 of FIG. 1.

The entire assembly 10 is illustrated in FIG. 2. A housing 20 carries bearings 32 and 34 for rotatably mounting a shaft 30 within the housing. A motor 22 drives the shaft 30 by means of an output pulley 24, V-belt 26, and drive pulley 28. A plurality of helical surfaces are mounted on the shaft. The helical surfaces comprise cutter supports for diamond abrasive cutter segments 36. The cutter segments 36 are preferably spaced uniformly along the lengths of the helical surfaces. The helical surfaces preferably are disposed in a perpendicular relationship to an extended surface 50 (FIG. 1) to be cut or planed.

A first right hand helical cutter support 12 may be double wound together with second right hand cutter support 14 over one-half of the longitudinal length of the device. The supports 12 and 14 are interleaved, preferably in a uniformly spaced relationship. First left hand helical cutter support 16 and second left hand helical cutter support 18 are secured on the shaft 30 over the second longitudinal half of the shaft. The right hand helical supports 12 and 14 terminate at a central position angularly displaced from each other by a particular angle such as 180°. The left hand helical supports 16 and 18 also terminate at the central position angularly displaced from each other by the particular angle such as 180° and angularly displaced by a particular angle such as 90° from the supports 12 and 14.

Figure 3:
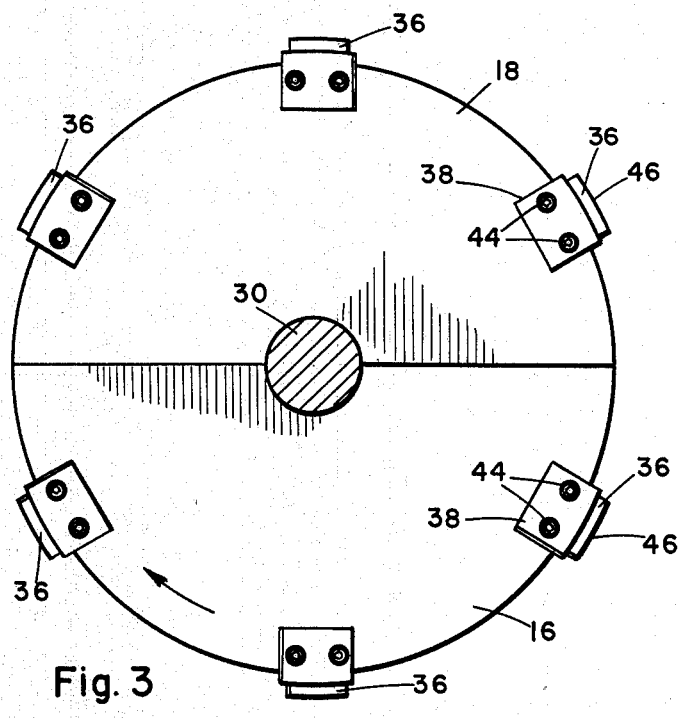
FIG. 3 is a further enlarged sectional view, partially broken away, taken on lines 3—3 of FIG. 2.

FIG. 3 illustrates the mounting of a plurality of cutter segments 36 on the first and second left-handed cutter supports 16 and 18. The diamond cutter segments 36 have a curved outer surface 46 which outer surfaces together define a cylindrical cutting surface as the shaft rotates. With rotation in the direction of the arrow (counterclockwise in FIG. 3), the use of oppositely wound helices causes a sweeping action for debris from the cutters 36. The debris is swept from the longitudinal center of the device to the outer ends. Also illustrated in FIG. 2 are the inner ends of the several helices. The use of double wound helices permits the termination of the helices every 90° at the center of the device and every 180° at the outer ends. Accordingly, a cutter segment may be positioned substantially on the longitudinal center line of the assembly every 90° resulting in a good overlap and regular cutting action at the center. It also provides for a balanced operation of the assembly 10 and causes vibrations to be minimized. Such a configuration also insures that debris will not build up in the center but rather will be swept in either direction toward the ends of the assembly.

The cutter supports 12, 14, 16 and 18 are preferably provided with openings 52 at uniformly spaced positions between parts of adjacent cutter segments 36. The openings 52 are preferably provided with slotted configurations defined by grooves 54 and enlarged apertures 56 at the periphery of the supports. A cooling fluid such as water is adapted to be directed from a pressurized source 58 to the cutter supports 12, 14, 16 and 18 at a position to produce a flow of the fluid into the openings 52. The fluid then flows through the grooves 54 to the apertures 56 so as to contact the cutter segments 36 as the cutter segments engage the extended surface. In this way, the cutter segments 36 are cooled and lubricated by the fluid.

With the cutter assembly mounted on the chassis 11, the motor 22 is activated to rotate the cutter assembly in the direction illustrated. The vehicle then proceeds forward. Any irregularity, or surface coating, on the concrete surface will be cut away by the operation of the plural cutter segments 36. The irregularities are cut away in an even and extended pattern because of the extension of the helices 12, 14, 16 and 18 to a central position. The vehicle will track accurately such as to overlap with a previous cut since the use of the oppositely wound helices eliminates side forces. The elimination of side forces and the production of a satisfactory cutting, planing, or stripping operation are also facilitated by the provision of double wound helices and the balanced relationship of such helices. The disposition of the cutter segments in perpendicular relationship to the extended surface also facilitates the cutting operation and eliminates side forces. Debris produced in the cutting operation is swept to the outer ends of the cutter assembly. The cutter segments are cooled during the cutting operation so as to facilitate the cutting operation and minimize wear of the cutter segments, although these worn cutters may be easily released from their mounting and replaced.

In the embodiment shown in FIG. 8, fluid such as water is introduced to cutting apparatus, generally indicated at 70, from a position above the apparatus. The fluid flows downwardly along helical cutter supports 72 and 74 to a surface 76 to be cut or planed. As will be seen, the cutter supports 72 and 74 are disposed in substantially perpendicular relationship to the surface 76 at the position of contact of the supports 72 and 74 with the surface 76. The cutter support 72 may be defined by interleaved supports 80 and 82 and the cutter support 74 may be defined by interleaved supports 84 and 86 when the two supports are provided with a 180° relationship. However, each of the supports 72 and 74 may be formed from more than two interleaved segments which are provided with an anular relationship dependent upon the number of interleaved segments.

Cutter elements 90 are mounted at spaced increments along the peripheral surface of the cutter supports 80, 82, 84 and 86. The elements 90 are disposed in a balanced relationship. For example, pairs of the elements 90 are mounted on the supports 80 and 82 so that the elements in each pair are displaced from each other by an angle of 180° and are disposed at positions defining a single vertical plane substantially perpendicular to a rotational axis 92. A similar arrangement is provided for pairs of cutter elements 90 on the interleaved supports 84 and 86.

The apparatus described above has certain important advantages. For example, by disposing pairs of cutter elements 90 in the same vertical plane, a balanced arrangement is provided during the operation of the apparatus. Furthermore, if one of the segments in a pair should be damaged or lost, the other segment in the pair acts in a back-up capacity to perform the desired planing operation at the same planar position. This insures that the surface 76 is planed smoothly. The balanced operation of the cutter segments also provides for the rotation of the segments at increased speeds because of the planing provided by pairs of cutter elements and enhances the capacity of the segments to perform the desired work. Since the cutter segments operate on a balanced basis at high speeds, different units can be provided with the same diametrical dimensions but with different openings between cutter segments to control the work capabilities of the units.

The cutter elements 90 may have a standard construction. For example, each of the segments 90 may be approximately one inch (1") long and one eighth inch (⅛") wide. When the apparatus has a width of twenty-four inches (24"), a total contact area of approximately one and one half inches (1½") may be provided at any one instant by the cutter elements 90 against the surface 76 to be cut or planed. Since only a relatively small area of the surface 76 is engaged by the segments 90 at any one instant, the apparatus constituting this invention requires only relatively low amounts of power. This provides for a relatively small and portable apparatus.

Since the cooling fluid such as water flows along the cutter segments 80, 82, 84 and 86 to the surface 76, the fluid is transferred directly to the surface at the position being cut or planed. This provides for an efficient use of the cooling fluid at a relatively low volume of fluid and minimizes clean-up requirements during and after the cutting or planing operation. Furthermore, since the surface 76 is being contacted at each instant only at spaced positions, the cutter elements have an optimum opportunity to become cooled. This is facilitated by the air cooling between the cutter segments. As a result, the life of the cutter elements is prolonged. Since the cutter elements are relatively expensive, the cost of operating and maintaining the apparatus is minimized.

FIG. 9 shows another embodiment of the invention. In this embodiment, the cutter elements 91 on successive cutter segments are progressively positioned around the annular peripheries of the segments to define a helix whose axis is the rotational axis 92. For example, elements **91*a*, 91*b* and 91*c* on successive segments have a helical positioning such as shown in FIG. 9. The helix defined by these successive elements is in a pattern transverse to the helical pattern of the cutter segments 80, 82, 84 and 86. In this sense, the elements 91*a*, 91*b*, 91*c*, etc. define a helix on the helix defined by the cutter segments 80, 82, 84 and 86**.

The provision of a helix on a helix as defined in the previous paragraph provides certain important advantages. For example, it facilitates additional balancing of the apparatus. It also tends to minimize the power required at each instant since the elements **91*a*, 91*b*, 91*c***, etc. are successively presented as the segments rotate. It also tends to equalize the power required at progressive instants.

As will be appreciated, the different embodiments can be combined in various ways. For example, the embodiments shown in FIGS. 8 and 9 can be combined to provide a single embodiment. In combining the different embodiments, the advantages obtained from the different embodiments are also combined.

Figure 4:
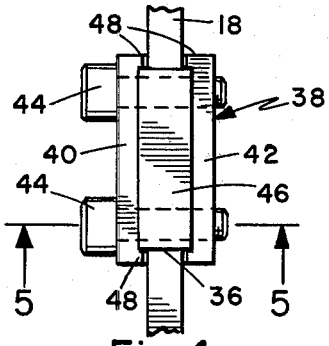
FIG. 4 is an edge view of one of the cutter mountings of FIG. 3.
Figure 5:
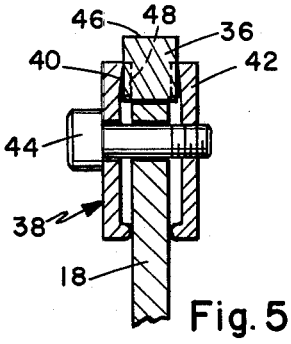
FIG. 5 is a sectional view taken on lines 5—5 of FIG. 4.
Figure 6:
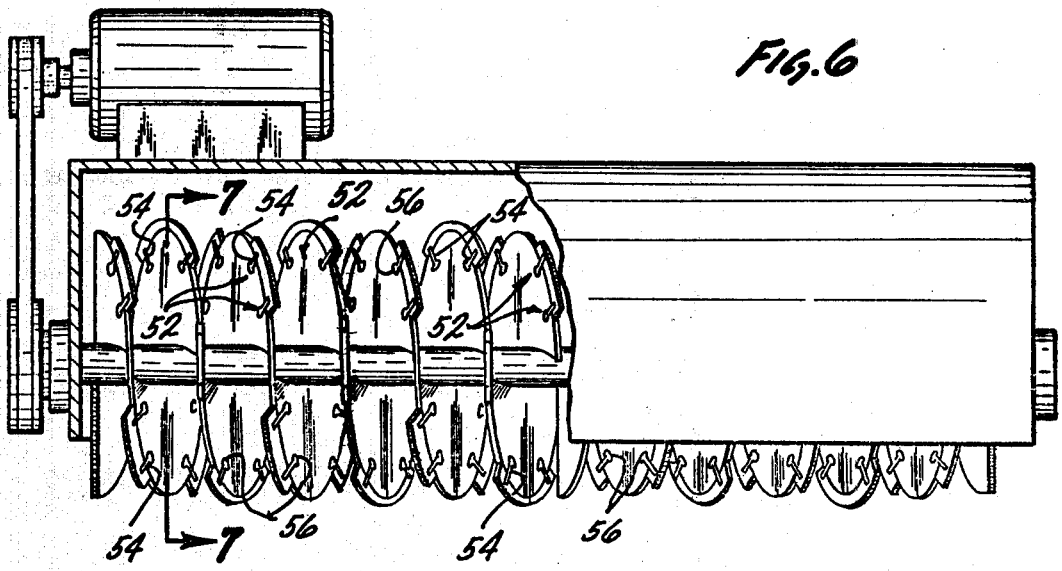
FIG. 6 is an enlarged sectional view, partially broken away, similar to that of FIG. 2 but showing a second embodiment of the invention.
Figure 7:
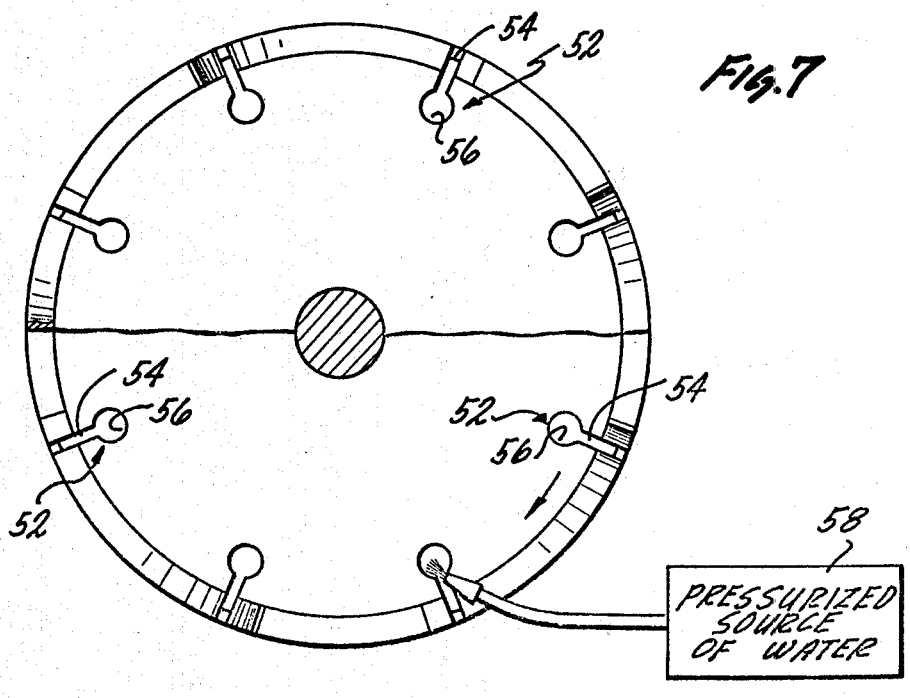
FIG. 7 is an enlarged sectional view taken substantially on the lines 7—7 of FIG. 6.

FIGS. 4 and 5 illustrate the details of the cutter mounting means 38. Clamp members 40 and 42 clamp between the helical support members, such as the typical helical support 16 illustrated, and the cutter element 36. The outer terminal portions 48 of the clamp members 40 and 42 grip the ends of the cutter segment 36. Threaded fasteners 44 pass through the clamp member 40, through the support surface 16 and are threaded into the clamp member 42. When the fasteners 44 are tightened, a positive clamping relationship is obtained, holding the cutter segment 36 in position on the support 16. The positive clamping relationship is facilitated by shaping the ends of each clamp member 42 to define a tooth which bites into the adjacent surface of the cutter segment 36 and one of the cutter supports 16 and 18. Since the assembly is utilized only in planing operations, where the segments penetrate the surface only a fraction of an inch, the clamping structure may protrude beyond the sides of the cutter segments without interfering with proper operation.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. A planar cutter assembly for planing of generally flat surfaces comprising:

abrasive cutting means, cutter support structure constructed to be mounted for rotation about a rotational axis parallel to said generally flat surface and to position said cutting means to engage said generally flat surface upon rotation of said cutter support structure, and cutter mounting means on said support structure for positioning and retaining said cutting means on said support structure, said mounting means being arranged on said support structure to define a cylindrical surface having an axis generally coincident to said rotational axis, said support structure being constructed to retain said mounting means in at least a pair of continuous helical patterns wound in opposite directions from a coterminal central position and having a symmetrical relationship to each other and to the coterminal central positions and having displaced terminations at the coterminal central position, the cutter support structure being constructed to support the cutting surfaces of the cutting means in essentially perpendicular relationship to the generally flat surface at the positions of contact between the cutting means and the generally flat surface.

2. A planar cutting assembly as set forth in claim 1 wherein means are included in the generally planar support structure for introducing a fluid to the cutting means to cool the cutting elements means in accordance with the cutting operations of the cutting means on the generally flat surfaces.

3. A planar cutting assembly as set forth in claim 1 wherein each of the first and second support means has a plurality of turns disposed in a particular pitch and wherein the cutting means comprise discrete cutting elements and wherein the cutting elements on each of the first and second support means are disposed at progressive angular positions on the successive turns of the associated support means to define for such cutting elements a helical pattern having a pitch different from the pitch of the continuous helical patterns defined by the associated support means but having the same rotational axis as that of the associated continuous helical patterns.

4. A planar cutter assembly for planing of generally flat surfaces comprising:

abrasive cutting means, cutter support structure constructed to be mounted for rotation about a rotational axis parallel to said generally flat surface and to position said cutting means to engage said generally flat surface upon rotation of said cutter support structure, cutter mounting means on said support structure for positioning and retaining said cutting means on said support structure, said mounting means being arranged on said support structure to define a cylindrical surface having an axis generally coincident to said rotational axis, said support structure being constructed to retain said mounting means in at least a pair of continuous helical patterns wound in opposite directions from a coterminal central position, each helical pattern of the support structure being defined by at least two pairs of interleaved components commencing at one end at limit positions substantially equidistant from the central position and substantially perpendicular to the rotational axis but angularly displaced from each other.

5. A planar cutting assembly as set forth in claim 4 wherein the interleaved components are displaced by an angle of approximately 180° at the commencing position and by an angle of approximately 180° at the central position and are displaced at the central position at positions substantially perpendicular to the rotational axis relative to each other and the helical patterns of the interleaved components in each helical pattern are displaced by an angle of approximately 90° from the interleaved components in the other helical pattern at the central position.

6. A planar cutting assembly set forth in claim 5 wherein the support structure defines openings at its periphery with the cutting means and means are provided for introducing fluid to the support structure at a position radially interior to the cutting means to obtain a flow of fluid into such openings and then to the cutting means providing the cutting operation on the generally flat surfaces.

7. A planar cutting assembly as set forth in claim 5 wherein the cutting means comprise discrete cutting elements and wherein the cutting elements are disposed at progressive angular positions on each of the helical patterns in a vertical plane along the rotational axis of the cutter support structure to define a helical path extending in a direction transverse to the continuous helical patterns but having the rotational axis of the continuous helical pattern and wherein the cutting elements are disposed on the two interleaved components of each helical pattern at positions defining a single vertical plane substantially perpendicular to the rotational axis.

8. A planar cutting assembly as set forth in claim 7 wherein a cooling fluid is introduced to the cutter mounting means at a position above the cutter mounting means.

9. A planar cutting assembly as set forth in claim 4 wherein the cutting means comprise discrete cutting elements and wherein the cutting elements are disposed on the two interleaved components of each helical pattern at positions defining a single vertical plane substantially perpendicular to the rotational axis.

10. A cutter assembly for cutting extended surfaces, including, first support means rotatable on a particular axis and defining a first helically wound support surface extending helically in a first direction to a control position from a first laterally displaced position the first support means defining a first and second interleaved helical surfaces uniformly spaced from each other, second support means rotatable on the particular axis and defining a second helically wound surface extending helically, in a second direction opposite to the first direction, to the central position from a second laterally displaced position on the opposite side of the central position from the first laterally displaced position, the second support means defining third and fourth interleaved helical surfaces uniformly spaced from each other, abrasive cutting means disposed on the surfaces of the first support means and the second support means, means for retaining the cutting means on the surfaces of the first and second support means, and means for producing a rotation of the first and second support means.

11. The cutter assembly set forth in claim 10, wherein the pitch of the first support means is in the first direction at a particular angle and the pitch of the second support means is in the second direction at the particular angle, and wherein the first and second interleaved surfaces terminate at the central position in a plane substantially perpendicular to the rotational axis and terminate at the first laterally displaced position in a plane substantially perpendicular to the rotational axis and wherein the third and fourth interleaved surfaces terminate at the central position in a plane substantially perpendicular to the rotational axis and terminate at the second laterally displaced position in a plane substantially perpendicular to the rotational axis.

12. The planar cutting assembly as set forth in claim 11, wherein the first and second means are constructed to present the cutting means to the extended surfaces in substantially perpendicular relationship to the extended surfaces and wherein the abrasive cutting means on the first and second interleaved surfaces are disposed in a helix having an axis corresponding to the rotational axis but transverse to the first and second interleaved helical surfaces and wherein the abrasive cutting means on the third and fourth interleaved surfaces are disposed in a helix having an axis corresponding to the rotational axis but transverse to the third and fourth interleaved helical surfaces.

13. The cutter assembly set forth in claim 11 wherein the terminations in the first and second interleaved helical surfaces are angularly displaced from each other by a particular angle in the plane perpendicular to the rotational axis, and the terminations in the third and fourth interleaved helical surfaces are angularly displaced from each other by the particular angle in the plane perpendicular to the rotational axis.

14. The planar cutting assembly as set forth in claim 11 where the first and second support means are constructed to introduce a liquid to the discrete abrasive elements to cool the elements in accordance with the cutting operation of the abrasive elements and wherein means are provided to introduce cooling fluid to the first and second support means.

15. The planar cutting assembly as set forth in claim 14 wherein the first and second support means are provided with openings at their surfaces at positions radially interior to the abrasive cutting means to receive the cooling fluid and provide for the introduction of the cooling fluid to the cutting means.

16. The planar cutting assembly as set forth in claim 11 wherein the first and second means are constructed to present the cutting means to the extended surfaces in substantially perpendicular relationship to the extended surfaces and the abrasive cutting means on the first and second interleaved helical surfaces are disposed in a plane perpendicular to the helical axis and the abrasive cutting means on the third and fourth interleaved helical surfaces are disposed in a plane perpendicular to the helical axis.

17. A cutter assembly for cutting an extended surface, including, first support means helically wound as a left-handed screw with a particular pitch and extending from a first longitudinally displaced position to a central position, a second support means helically wound as a right-handed screw with the particular pitch and extending to the central position from a second longitudinally displaced position on the opposite side of the central position from the first longitudinally displaced position, the distance between the central position and the second longitudinally displaced position being substantially equal to the distance between the central position and the first longitudinally displaced position, the first and second support means being symmetrical relative to each other and to the central position and having displaced terminations at the central position, means for supporting the first and second support means for simultaneous rotation on a common axis relative to the extended surfaces, and a plurality of cutter elements disposed at spaced positions along the surfaces of the screws defined by the first and second support means for cutting the extended surfaces in accordance with the rotation of the first and second support means, the screws defined by the first and second support means extending in a direction substantially perpendicular to the extended surface at the position of engagement of the first and second support means with the extended surface.

18. A cutter assembly as set forth in claim 17 wherein openings are provided in the surfaces of the first and second support means at positions radially interior to the cutter elements between adjacent pairs of cutter elements and wherein means are included for providing for the introduction of a cooling fluid to the openings at the positions radially interior to the cutting elements to obtain a cooling of the cutting elements as the cutter elements cut the extended surface.

19. A cutter assembly for cutting an extended surface, including, first support means helically wound as a lefthanded screw with a particular pitch and extending from a first longitudinally displaced position to a central position, a second support means helically wound as a right-handed screw with the particular pitch and extending to the central position from a second longitudinally displaced position on the opposite side of the central position from the first longitudinally displaced position, the distance between the central position and the second longitudinally displaced position being substantially equal to the distance between the central position and the first longitudinally displaced position, the first and second support means being symmetrical relative to each other and to the central position and having displaced terminations at the central position, means for supporting the first and second support means for simultaneous rotation on a common axis relative to the extended surfaces, and a plurality of cutter elements disposed at spaced positions along the surfaces of the screws defined by the first and second support means for cutting the extended surfaces in accordance with the rotation of the first and second support means, the screws defined by the first and second support means extending in a direction substantially perpendicular to the extended surface at the position of engagement of the first and second support means with the extended surface, each of the first and second support means being double wound with each of the windings in the double winding being uniformly spaced from the other winding in the double winding.

20. A cutter assembly as set forth in claim 19 including means on the first and second support means for providing for the introduction of a cooling fluid to the cutter elements as the cutter elements cut the extended surface and wherein each of the windings in the double windings is displaced by an angle of 180° from the other winding at the central position and at the longitudinal limit position and wherein each of the double windings is displaced by angles of 90° from the other double winding at the central position.

21. The cutter assembly set forth in claim 19 wherein the cutter elements are disposed on the double windings in each of the support means so that elements on the double windings in each support means lie in planes substantially perpendicular to the common axis.

22. A cutter assembly as set forth in claim 19 wherein each of the windings in the double windings terminates at the same central position and at the same longitudinal limit position in a particular angularly displaced relationship to the other winding in the double winding.

23. The cutter assembly set forth in claim 22 wherein the cutter elements are disposed at progressive positions on successive screw turns of each of the double windings in the first support means to define a helical screw having the common axis but having a pitch different from the pitch of the first support means and the cutter elements are disposed at progressive positions on successive screw turns of each of the double windings of the second support means to define a helical screw having the common axis but having a pitch different from the pitch of the second support means.

24. A cutter assembly for cutting an extended surface, including, first support means helically wound as a lefthanded screw with a particular pitch and extending from a first longitudinally displaced position to a central position, a second support means helically wound as a righthanded screw with the particular pitch and extending to the central position from a second longitudinally displaced position on the opposite side of the central position from the first longitudinally displaced position, means for supporting the first and second support means for rotation relative to the extended surfaces, a plurality of cutter elements disposed at spaced positions along the surfaces of the screws defined by the first and second support means for cutting the extended surfaces in accordance with the rotation of the first and second support means, the screws defined by the first and second support means extending in a direction substantially perpendicular to the extended surface at the position of engagement of the first and second support means with the extended surface, the cutter elements being disposed at progressive positions on successive screw turns of the first support means to define for the cutter elements a helical screw having the common axis but having a second particular pitch different from the first particular pitch and the cutter elements being disposed at progressive positions on successive screw turns of the second support means to define for the cutter elements a helical screw having the common axis but having a third particular pitch different from the first particular pitch of the second support means, the second and third particular pitches being substantially equal but inclined to opposite sides of a vertical plane.

* * * * *